United States Patent [19]

Kandler

[11] Patent Number: 4,893,597

[45] Date of Patent: Jan. 16, 1990

[54] ENGINE CYLINDER ASSEMBLY HAVING AN INTAKE CROSS-PASSAGEWAY

[75] Inventor: William C. Kandler, New Holstein, Wis.

[73] Assignee: Tecumseh Products Company, Tecumseh, Mich.

[21] Appl. No.: 342,186

[22] Filed: Apr. 24, 1989

[51] Int. Cl.[4] ..... F02F 7/00

[52] U.S. Cl. ..... 123/195 HC; 123/196 W; 123/195 C

[58] Field of Search ..... 123/195 R, 195 C, 195 HC, 123/196 W, 198 E, 658

[56] References Cited

U.S. PATENT DOCUMENTS

| | | | |
|---|---|---|---|
| 725,295 | 4/1903 | Strang | 123/63 |
| 830,099 | 9/1906 | Packard | 123/195 R |
| 908,641 | 1/1909 | Barthel | 123/56 AA |
| 929,554 | 7/1909 | Clarke | 123/41.78 |
| 1,209,389 | 12/1916 | Brown | 123/84 |
| 1,297,350 | 3/1919 | Hinchliffe | 123/543 |
| 1,434,069 | 10/1922 | Spetescu | 123/543 |
| 1,893,183 | 1/1933 | Sleffel | 123/543 |
| 2,227,247 | 12/1940 | Conover | 123/41.82 R |
| 2,293,352 | 8/1942 | Molina | 123/547 |
| 3,230,944 | 1/1966 | Kiekhaefer | 123/56 AA |
| 4,103,664 | 8/1978 | Iida et al. | 123/658 |
| 4,548,167 | 10/1985 | Tamba | 123/41.56 |
| 4,579,092 | 4/1986 | Kandler | 123/196 CP |
| 4,756,280 | 7/1988 | Tamba et al. | 123/196 W |
| 4,790,273 | 12/1988 | Oguri et al. | 123/195 HC |

FOREIGN PATENT DOCUMENTS

| | | | |
|---|---|---|---|
| 0004918 | 1/1977 | Japan | 123/658 |

*Primary Examiner*—Charles J. Myhre
*Assistant Examiner*—Weilun Lo
*Attorney, Agent, or Firm*—Albert L. Jeffers; Richard L. Robinson

[57] ABSTRACT

An air-cooled engine having a vertical crankshaft and a horizontal cylinder. The cylinder is cast aluminum alloy and has the intake and exhaust valves located next to one another on one side of the cylinder, with the carburetor located on the other side of the cylinder. An intake cross-passageway integrally cast in part with the cylinder passes under the piston bore to connect the intake valve to the carburetor. For casting purposes, the lower side of the passageway is open in the cylinder casting to permit removal of the passageway casting core and forming an opening having side walls extending transverse to the piston bore extending from the passageway to the exterior of the cylinder. A cover having side walls corresponding to and lying adjacent the side walls of the opening is disposed in the opening. The cover has a curved inner surface corresponding to the curvature of the passageway.

13 Claims, 2 Drawing Sheets

ENGINE CYLINDER ASSEMBLY HAVING AN INTAKE CROSS-PASSAGEWAY

BACKGROUND OF THE INVENTION

1. Field of the Invention

The present invention pertains generally to air-cooled internal combustion engines, and more particularly to a cast cylinder assembly for such an engine having an intake cross-passageway cast integrally therewith.

2. Description of Related Art

A known configuration of an air-cooled single cylinder internal combustion engine involves an arrangement wherein the crankshaft is disposed vertically and the cylinder and piston bore are horizontal. The intake and exhaust valves are located side-by-side relatively close to one another on one side of the cylinder with the intake valve located above the exhaust valve. The valves are oriented parallel to the piston bore and the valve heads and valve seats are located near the head of the cylinder at the interface between the cylinder and the cylinder head. A valve cavity associated with each of the intake and exhaust valves communicates with the piston bore around the respective valve head (when the valve is open) via a connecting passageway in the cylinder head. The valves are lifted and opened in appropriate sequence by a common camshaft located in the crankcase.

It is desireable that the carburetor and muffler be located on opposite sides of the cylinder to avoid the deleterious effects of exhaust heat on the operation of the carburetor and to avoid the safety hazard caused by proximity of the muffler to the fuel in the carburetor. The disposition of the intake and exhaust valves immediately next to one another on the same side of the cylinder is in conflict with the desired arrangement of the carburetor and muffler. Consequently, it is known to route an external intake tube from the intake valve cavity over across the cylinder to the carburetor located on the opposite side. This arrangement adds to the cost of the engine by requiring the manufacture and connection of a separate component, namely the external tube. Furthermore, by having the intake valve located above the exhaust valve and by routing the intake tube over the cylinder, the carburetor must be mounted relatively high with respect to the mounting base of the engine. This reduces the space available above the carburetor for mounting a gravity feed fuel tank, so that the volume of the tank must be sacrificed or else the overall profile of the engine must suffer an increase in height. Also, the disposition of the exhaust valve below the intake valve results in less efficient cooling of the exhaust valve because it is less exposed to the flow of cooling air.

A known arrangement of a partially cast intake tube crossing over the cylinder is shown in U.S. Pat. No. 4,548,167. The cylinder assembly shown therein provides an intake passageway which is for the most part cast integrally with the cylinder. An opening in the side of the passageway is provided in view of casting considerations to allow removal of the casting core. The opening is closed by a separate cover bolted to the cylinder. The interface between the cover and cylinder is a peripheral planar surface which intersects the passageway at the opening at an acute angle, with the cover being disposed exteriorly of the opening. A manufacturing disadvantage of the arrangement of U.S. Pat. No. 4,548,167 is that after casting, flashing can be present around the peripheral planar sealing surface and can extend into the passageway.

It would be desireable to provide a cast cylinder assembly for a horizontal cylinder air-cooled engine in which an intake cross-passageway connecting the intake valve on one side of the cylinder with the carburetor on the other side of the cylinder is provided at lower manufacturing cost. The present invention accomplishes this goal.

SUMMARY OF THE INVENTION

The present invention involves a cylinder casting for a horizontal cylinder air-cooled engine in which a cross-passageway is cast integrally therewith. The cross-passageway connects the intake valve on one side of the cylinder with the carburetor on the other side of the cylinder. To permit removal of the casting core which forms the passageway, one side of the passageway is open along its length while the remainder of the passageway is defined by the cylinder casting. The open side of the passageway is provided with an opening having side walls extending transverse to the cylinder. A cover having side walls is inserted into the opening to close it, with the side walls of the cover laying adjacent the side walls of the opening. The inner surface of the cover is curved to correspond to the curvature of the passageway.

Several advantages over the prior art are provided by the provision of side walls in the opening to which side walls on the cover correspond. One such advantage is that the sealing surface between the cover and opening is displaced from the passageway itself so that the risk of flashing at the sealing surface extending into the cavity is eliminated. Another advantage is that the cover is more positively located with respect to the opening since the adjacent corresponding side walls of the cover and opening limit movement of the cover during installation.

In accordance with a further feature of the invention, the intake valve is located below the exhaust valve and the intake cross-passageway is correspondingly disposed under the cylinder rather than over the cylinder. This allows the carburetor to be mounted lower, permitting an increased capacity fuel tank to be located over the carburetor without increasing the height profile of the engine.

The invention, according to an embodiment thereof, involves an internal combustion engine of the type having a vertical crankshaft and a horizontal cylinder. The engine includes a cast cylinder assembly having a cast cylinder. The cast cylinder includes a piston bore, an intake valve cavity for receipt of an intake valve, and an exhaust valve cavity for receipt of an exhaust valve. The intake and exhaust valve cavities are located proximate one another on one side of the piston bore, and an integrally cast cross-passageway communicates with the intake valve cavity and curves around the piston bore to the other side of the piston bore opposite the intake and exhaust valve cavities. An opening having side walls communicates with the cross-passageway and is open to the exterior of the cylinder. A cover is provided having side walls and a curved inner surface having a curvature corresponding to the curvature of the cross-passageway. The curved inner surface and side walls of the cover are disposed within the opening with the side walls of the cover lying adjacent the side walls of the opening. Means are provided for sealing the cover to the cylinder to preclude air passage through the opening.

It is an object of the present invention to provide an improved cylinder assembly for an internal combustion engine having an integral intake passageway.

Further objects and advantages of the invention will become apparent from the following descriptions and claims.

DESCRIPTION OF THE PREFERRED EMBODIMENT

Figure 1:
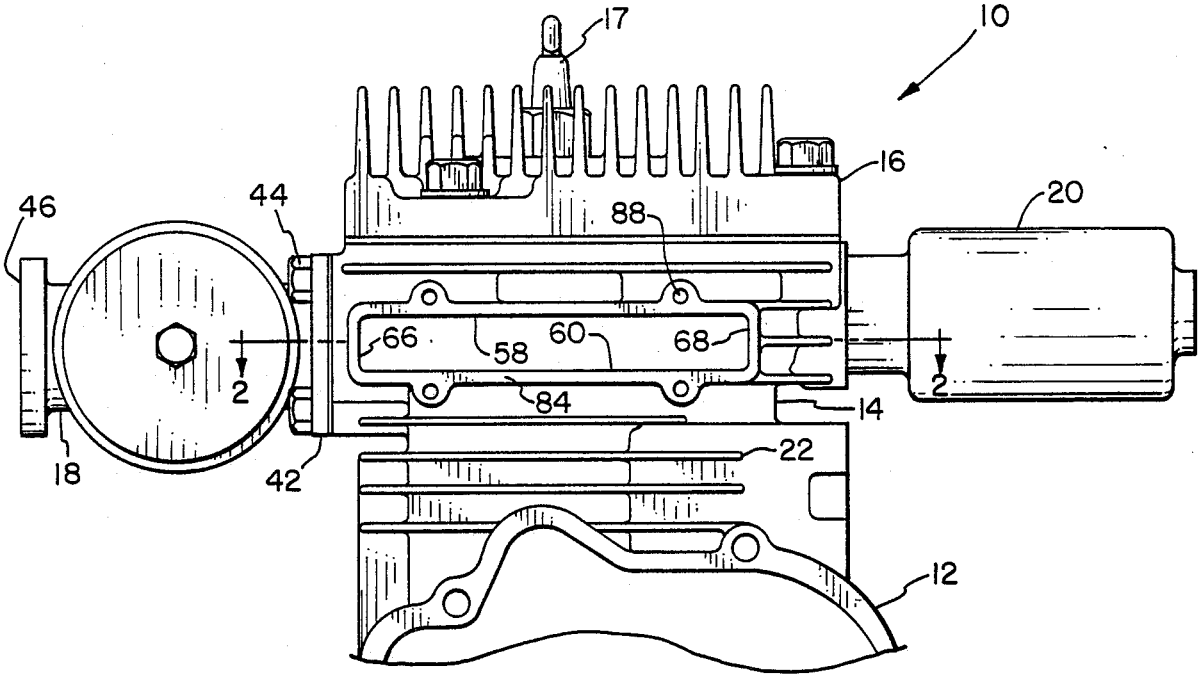
FIG. 1 is a bottom plan view of the cylinder assembly of an air-cooled internal combustion engine of the type having a vertical crankshaft and a horizontal cylinder, and particularly showing the intake cross-passageway with cover removed.

With reference to FIGS. 1-4, a cylinder assembly 10 in accordance with the present invention is illustrated. Cylinder assembly 10 is comprised of an integral aluminum alloy casting including crankcase 12 and cylinder 14. Other principal components attached to cylinder assembly 10 include cylinder head 16 having a spark plug 17, carburetor 18 and muffler 20.

Cylinder 14 includes several plate-like cooling fins 22 cast integrally with cylinder 14 and extending outwardly therefrom. Cooling fins 22 are arranged in spaced relationship generally parallel to one another and are oriented transverse to cylinder 14. A piston bore 24 centrally located in cylinder 14 is delimited by cylinder wall 26. Adjacent piston bore 24 and oriented generally parallel thereto are intake valve cavity 28 and exhaust valve cavity 30. An intake valve and an exhaust valve (not shown) have valve stems reciprocally received in bores 32 and 34 of intake valve cavity 28 and exhaust valve cavity 30, respectively. An exhaust port 36 oriented horizontally and transverse to cylinder 14 communicates exhaust valve cavity 30 to the outside of cylinder 14. Threadedly received within exhaust port 36 is threaded extension 38 of muffler 20.

Situated on the side of cylinder 14 opposite intake and exhaust valve cavities 28 and 30 is intake port 40 which is oriented horizontally and transverse to cylinder 14. Carburetor 18 is mounted to intake port 40 in communication therewith by flange 42 which is connected to cylinder 14 by threaded bolts 44. Carburetor 18 includes an air intake port 46 for connection to an air filter (not shown), and shafts 48 and 50 are connected to control linkage (not shown) for operating the choke and throttle plates in carburetor throat 52.

An intake cross-passageway 54 circumscribes a portion of piston bore 24 and passes thereunder, connecting intake port 40 and intake valve cavity 28 in communication with one another. The top of cross-passageway 54 is delimited by inner wall 56 which constitutes part of the circumferential wall 26 which on its opposite side delimits piston bore 24. Cross-passageway 54 is delimited in the axial direction of cylinder 14 by end walls 58 and 60 (see FIG. 1). Walls 56, 58 and 60 are cast integrally with cylinder 14 and together form three contiguous sides of cross-passageways 54 which is substantially rectangular in crosssectional profile. The fourth side of cross-passageway 54 is delimited by wall 62 of passage cover 64. Cover 64 is received in a rectangular opening in cylinder 14 which communicates with cross-passageway 54 tangentially thereto. The rectangular opening is delimited by outward extensions of end walls 58 and 60 forming the opposing long sides of the opening, and by side walls 66 and 68 forming the opposing short sides of the opening.

Figure 3:
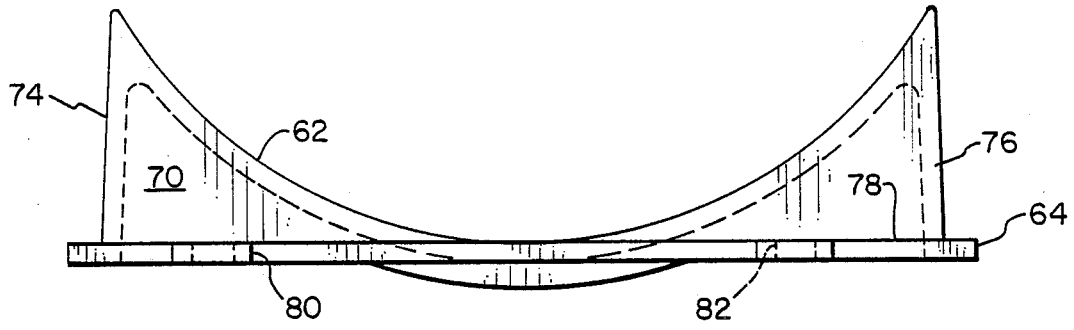
FIG. 3 is an elevational view of the cross-passageway cover of the cylinder assembly of FIGS. 1 and 2, as viewed in the axial direction of the cylinder assembly.
Figure 4:
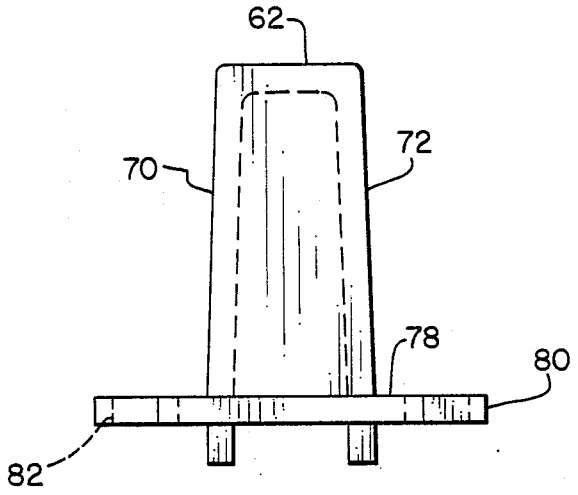
FIG. 4 is an elevational side view of the cross passageway cover of FIG. 3, as viewed in a direction transverse to the cylinder assembly.

Referring particularly to FIGS. 3 and 4, cover 64 is illustrated in greater detail. Curved wall 62 is situated between and joined to a pair of side walls 70 and 72 disposed generally orthogonal thereto such that cover 64 is generally U-shaped when viewed in cross-section along a plane parallel to the axis of cylinder 14 and extending along a radius therefrom. The depth of the "U" varies in the circumferential direction from a minimum at the center of the cover to a maximum at the ends. Side walls 70 and 72 overlie in parallel relationship the extensions of end walls 58 and 60 when cover 64 is in place in the rectangular opening of cylinder 14. Likewise, the ends 74 and 76 of cover 64 overlie in parallel relationship side walls 66 and 68 of the rectangular opening. Extending substantially orthogonally from walls 70 and 72 is a perimetrical sealing flange 78 having four ears 80 extending therefrom in the same plane, with each ear surrounding a bolt hole 82. Sealing flange 78 mates with sealing surface 84 which surrounds the rectangular opening of cylinder 14, and the interface between the two is sealed by gasket 86. Located in sealing surface 84 are four threaded bolt holes 88 which align with the bolt holes 82 of sealing flange 78. A corresponding bolt 90 is received through each of holes 82 and 88 to secure cover 64 in place in the rectangular opening and to compress gasket 86.

Figure 2:
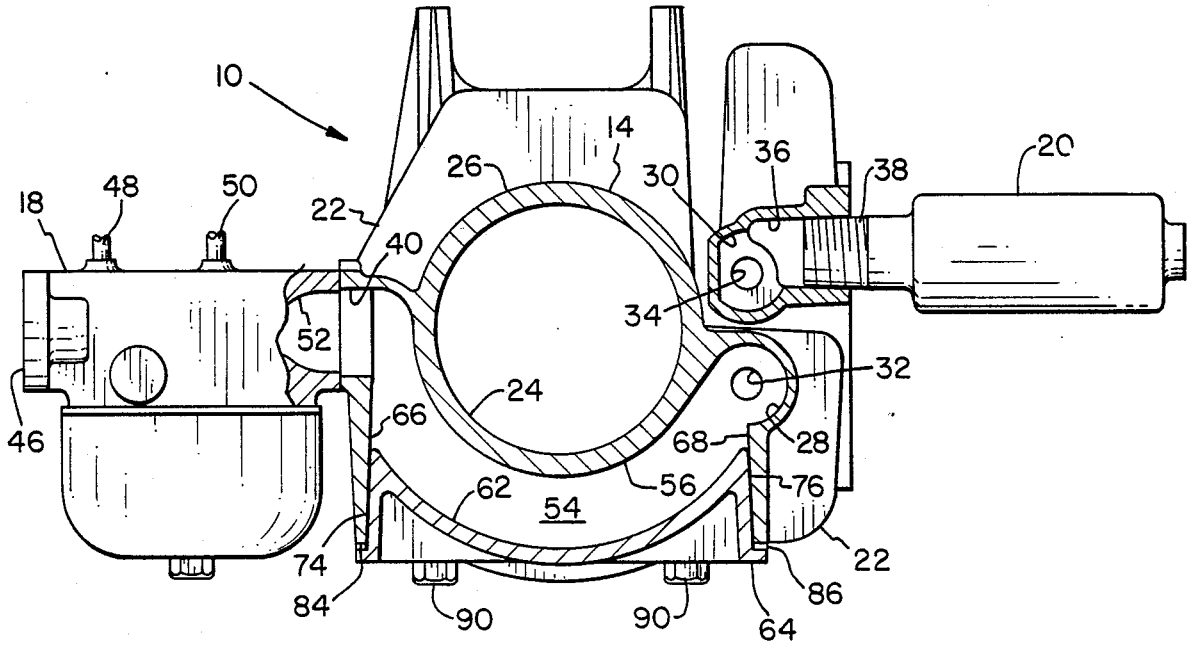
FIG. 2 is a cross-sectional view of the cylinder assembly of FIG. 1 taken along section line 2—2 of FIG. 1 and viewed in the direction of the arrows, showing the cover of the crosspassageway in place.

Referring particularly to FIG. 2, cylinder assembly 10 is shown in its normal working orientation. It should be noted that the exhaust valve is located above the intake valve and is therefore better exposed to cooling airflow than prior arrangements in which the exhaust valve is below the intake valve. Furthermore, the location of the intake valve below the exhaust valve permits the cross-passageway 54 to be located on the bottom side of cylinder 14, i.e., cross-passageway 54 passes under cylinder 14 rather than over it. This makes it possible to locate intake port 40 low with respect to cylinder 14, and consequently carburetor 18 also can be located low, almost at the mounting base of the engine. Hence, there is plenty of room above carburetor 18 to locate a large capacity fuel tank for gravity feeding gasoline to carburetor 18, while maintaining a low overall height profile for the engine.

While the present invention has been particularly described in the context of a preferred embodiment and method, it will be understood that the invention is not limited thereby. Therefore, it is intended that the scope of the invention include any variations, uses or adaptations of the invention following the general principles thereof and including such departures from the disclosed embodiment and method as come within known or customary practice in the art to which the invention pertains and which fall within the appended claims or the equivalents thereof.

What is claimed is:

1. In an internal combustion engine of the type having a crankshaft and a cylinder, a cast cylinder assembly comprising:

a cast cylinder including: a piston bore, an intake valve cavity for receipt of an intake valve, an exhaust valve cavity for receipt of an exhaust valve, the intake and exhaust valve cavities located proximate one another on one side of the piston bore, an integrally cast cross-passageway communicating with the intake valve cavity and curving around the piston bore to the other side of the piston bore opposite the intake and exhaust valve cavities, an opening having side walls communicating with the cross-passageway and open to the exterior of the cylinder;

a cover having side walls and a curved inner surface having a curvature corresponding to the curvature of the crosspassageway, the curved inner surface and side walls of the cover being disposed within the opening with the side walls of the cover lying adjacent the side walls of the opening; and means for sealing the cover to the cylinder to preclude air passage through the opening.

2. The engine of claim 1, in which said crankshaft is vertical and said piston bore is horizontal and the cross-passageway curves under the piston bore.

3. The engine of claim 1, in which the intake valve is disposed below the exhaust valve.

4. The engine of claim 1, in which the side walls of the opening extend outwardly from the cross-passageway transverse to the piston bore.

5. The engine of claim 4, in which the opening is surrounded by a perimetrical sealing surface disposed substantially orthogonally to the side walls of the opening.

6. The engine of claim 5, in which the cover includes a perimetrical sealing flange extending outwardly from the side walls of the cover substantially orthogonally thereto.

7. The engine of claim 6, in which said sealing flange of the cover overlies the perimetrical sealing surface around the opening of the cylinder, and said sealing means includes a gasket disposed between the sealing flange and the sealing surface.

8. A cast cylinder assembly for an internal combustion engine of the type having a vertical crankshaft and a horizontal cylinder, comprising:

a horizontally extending cast cylinder having a piston bore, an intake valve cavity, an exhaust valve cavity, the intake and exhaust valve cavities both being located on one side of the piston bore, a cross-passageway having a first end in communication with the intake valve cavity and a second end disposed on the other side of the piston bore diametrically opposite the intake and exhaust valve cavities, the cross-passageway circumscribing a portion of the piston bore and being disposed therebelow, and an opening communicating with a side of the cross-passageway and open to the exterior of the cylinder;

a cover having a curved inner wall delimiting in part the cross-passageway; and means located radially outwardly of the curved inner surface of the cover for sealing the cover to the cylinder to preclude air passage through the opening.

9. The engine of claim 8, in which the intake valve is disposed below the exhaust valve.

10. The cast cylinder assembly of claim 8, in which the opening is delimited by side walls extending outwardly transverse to the piston bore.

11. The engine of claim 10, in which the opening is surrounded by a perimetrical sealing surface disposed substantially orthogonally to the side walls of the opening.

12. The engine of claim 11, in which the cover includes a perimetrical sealing flange extending outwardly from the side walls of the cover substantially orthogonally thereto.

13. The engine of claim 12, in which said sealing flange of the cover overlies the perimetrical sealing surface around the opening of the cylinder, and said sealing means includes a gasket disposed between the sealing flange and the sealing surface.

* * * * *